United States Patent [19]

Massonnet

[11] Patent Number: 4,856,845

[45] Date of Patent: Aug. 15, 1989

[54] ARMCHAIR WITH SUPPLE BACKREST

[75] Inventor: Henry Massonnet, Nurieux-Volognat, France

[73] Assignee: Societe Pour la Transformation des Matieres Plastiques Stamp, Nurieux-Volognat, France

[21] Appl. No.: 228,002

[22] Filed: Aug. 3, 1988

[30] Foreign Application Priority Data

Aug. 18, 1987 [FR] France ..... 87 11787

[51] Int. Cl.[4] ..... A47C 3/00

[52] U.S. Cl. ..... 297/286; 297/290; 297/457

[58] Field of Search ..... 297/286, 290, 457

[56] References Cited

U.S. PATENT DOCUMENTS

| | | | |
|---|---|---|---|
| 186,394 | 1/1877 | Wood | 297/286 |
| 3,146,028 | 8/1964 | Grosfillex | 297/457 |
| 3,756,656 | 9/1973 | Weick | 297/457 |
| 4,131,315 | 12/1978 | Vogtherr | 297/286 |
| 4,157,203 | 6/1979 | Ambasz | 297/286 |
| 4,341,419 | 7/1982 | Sebel | 297/248 |
| 4,418,958 | 12/1983 | Watkin | 297/457 |
| 4,533,194 | 8/1985 | Fleishmann | 297/457 |
| 4,557,521 | 12/1985 | Lange | 297/457 |

*Primary Examiner*—Francis K. Zugel

*Attorney, Agent, or Firm*—Dowell & Dowell

[57] ABSTRACT

An armchair whose arms and backrest are joined by an elastic element, while the backrest extends well above the arms so that the pressure generated by the user leaning back against the backrest causes it to bend or deflect, thus improving comfort.

4 Claims, 1 Drawing Sheet

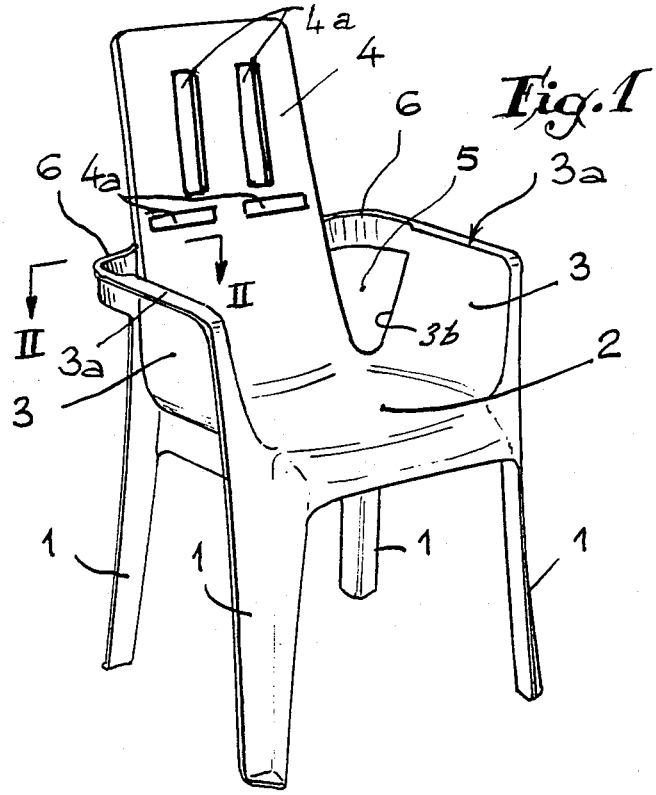
Fig.1
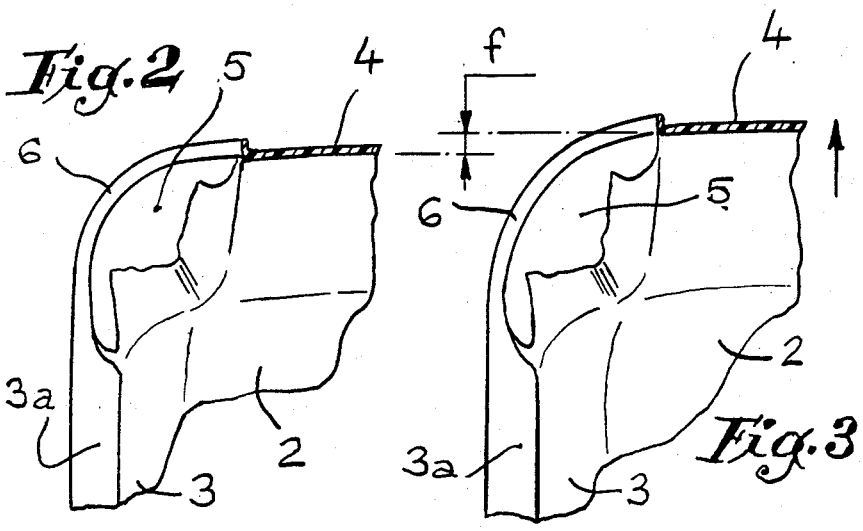
Fig.2
Fig.3

ARMCHAIR WITH SUPPLE BACKREST

BACKGROUND OF THE INVENTION

Field of the Invention

The present invention relates to an armchair with supple backrest.

History of the Related Art

Furniture, and in particular seats, are being made more and more in one piece by injection of a plastics material or other process of manufacture. The seats thus manufactured, and more particularly armchairs, are rigid, with the result that they are not comfortable. In particular, their backrest is not at all supple and it is painful to sit for a long period of time in an armchair of this type.

SUMMARY OF THE INVENTION

The improvements forming the subject matter of the present invention aim at overcoming the aforementioned drawbacks by producing an armchair whose backrest presents a certain suppleness while being sufficiently resistant.

To that end, the arms and the backrest of the armchair according to the invention are connected by an element made of a semi-rigid material, so that the fact of the user leaning his back on the backrest causes a slight non-permanent deformation of the connecting elements in question.

In order to render the armchair even more comfortable, the backrest is extended well above the arms of the armchair and the elements for connecting them with the backrest, so that the backrest itself presents, above the elements, an appreciable suppleness.

The combination of the above two characteristics considerably improves the suppleness and consequently the comfort of an armchair.

Although the connecting elements can be made separately and fitted on an existing armchair, the present invention envisages more particularly, but not exclusively, an armchair made in one piece from a semi-rigid plastic material which ensures a good resistance for the chair and yet a sufficient suppleness for the backrest and the elements for connecting it to the arms.

BRIEF DESCRIPTION OF THE DRAWINGS

The invention will be more readily understood on reading the following description with reference to the accompanying drawings, in which:

FIG. 1 is a view in perspective illustrating an armchair moulded in one piece from plastic material and incorporating the improvements according to the invention.

FIG. 2 is a view in partial section on a larger scale along II.II (FIG. 1).

FIG. 3 is a view similar to that of FIG. 2 but illustrating how the elements for connecting the backrest and the arms are deformed when the user sits back on the backrest.

DESCRIPTION OF THE PREFERRED EMBODIMENT

Referring now to the drawings, the armchair illustrated in FIG. 1 essentially comprises four legs 1 extending from a seat surface 2, two arms or armrests 3 and a backrest 4.

It will be observed that the two front legs are made in the form of an angle of which one of the flanges extends to form a horizontal edge **3*a* constituting the top of the arms or armrests 3 and on which the user's fore-arms rest when sitting down. The backrest 4 is moulded with the other parts of the armchair in one piece without any supple connection with the seat surface 2**.

It will be noted that the rear edge **3*b* of the armrests determines with the corresponding edge of the backrest 4 a wide void or opening 5** in the form of a V pointing towards the surface of the seat.

According to the invention, the edge **3*a* and the top of the edge 3*b* of each arm or armrest 3 is joined with the backrest 4 by means of a connecting element 6 roughly in the form of a rounded angle. It will be observed that the connecting elements 6 are much less thick than the width of the top edges 3*a*** of the arms or armrests, this thickness being roughly equal to that of the assembly of the walls of the armchair, whether it be the seat surface, the armrests, or the backrest.

Thanks to the judicious choice of the plastic material with which the armchair according to the invention is made and which will be chosen in non-limiting manner as being polypropylene, an armchair is obtained which is resistant but which, when the user leans against the backrest, presents a certain elasticity at the level of its connecting elements 6, with the result that the backrest pivots very slightly towards the rear about its connection with the seat surface 2 when the user leans againt the backrest (FIG. 3), as the connection 6 deforms, i.e. it opens or deflects by an amount f. When this pressure is eliminated, the backrest naturally returns into normal position.

In a preferred embodiment, the backrest is high and extends well above the plane of the top **3*a* of the armrests. For example, the amount by which the backrest extends above the armrests is twice the distance between the armrests and the seat surface. By providing a suitable thickness for the backrest, an elasticity of its upper part is obtained which, in combination with the elasticity of the connecting elements 6, provides particular comfort for the user. The suppleness of the backrest may further be increased by providing cut-outs 4*a***, thanks to which the zone of the backrest near its free end is more supple than that joined to the surface of the seat, with the result that comfort is improved since the deformation follows the shape of the user's back.

It must, moreover, be understood that the foregoing description has been given only by way of example and that it in no way limits the domain of the invention which would not be exceeded by replacing the details of execution described by any other equivalents. In particular, an armchair may be designed, made of any material, but of which the connections between its armrests and its backrest are added, designed according to the invention, i.e. elastic due to their being made of a semi-rigid material.

What is claimed is:

1. In an armchair having legs, a seat, a pair of armrests extending generally upwardly from either side of the seat and a backrest which extends upwardly from the seat intermediate the armrests, wherein the legs, seat, armrest and backrest are integrally molded of a semi-rigid plastic material, the improvement comprising the backrest having a thickness so as to permit the backrest to deflect relative to the seat when pressure is applied thereto, the armrests including a main portion which is spaced relationship with respect to the backrest, said main portion of each armrest having an upper surface, each of said armrests having a generally arcuate connecting element extending from adjacent said upper surface of said main portion and integrally connecting said armrest with the backrest at a point spaced above the seat so as to define an opening between each armrest and the backrest which opening extends toward the seat, each of said connecting elements being yieldable so as to permit a limited deflection of the backrest relative to the seat when pressure is applied against the backrest.

2. The armchair of claim 1 in which said upper surface of each armrest includes an outwardly extending flange having a first width dimension, each of said connecting elements having a width dimension which is substantially less than said first width dimension.

3. The armchair of claim 1 in which the backrest includes an upper portion which extends upwardly relative to the armrest and said connecting elements a distance which is substantially equal to twice the distance between said upper surface of said armrest and the seat.

4. The armchair of claim 3 including openings in said upper portion of said backrest, said openings providing increased flexibility in said upper portion of the backrest.

* * * * *